US010168130B1

(12) United States Patent
Wang

(10) Patent No.: US 10,168,130 B1
(45) Date of Patent: Jan. 1, 2019

(54) HUNTING ARROWHEAD ASSEMBLY

(71) Applicant: Ching-Chu Wang, New Taipei (TW)

(72) Inventor: Ching-Chu Wang, New Taipei (TW)

( * ) Notice: Subject to any disclaimer, the term of this patent is extended or adjusted under 35 U.S.C. 154(b) by 0 days.

(21) Appl. No.: 15/964,823

(22) Filed: Apr. 27, 2018

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 4,998,738 A * 3/1991 Puckett ..... F42B 6/08 473/583
5,066,021 A * 11/1991 DeLucia ..... F42B 6/08 473/583
9,115,962 B1 * 8/2015 Weaver ..... F42B 6/08
9,329,006 B1 * 5/2016 Hansen ..... F42B 6/08
9,857,153 B1 * 1/2018 Redline ..... F42B 6/08

* cited by examiner

*Primary Examiner* — John Ricci
(74) *Attorney, Agent, or Firm* — LeClairRyan

(57) ABSTRACT

A hunting arrowhead assembly includes a shaft body, at least one guiding slot, a pair of access slots, a pin member, a pair of piercing members, a penetrating member and a cam member. The pin member is movable relative to the shaft body between a front position and a rear position. When the pin member is in the rear position, a piercing free end of each of the piercing members is disposed outwardly of a corresponding one of the access slots. When the pin member is in the front position, the piercing free end is retractable in the corresponding one of the access slots.

8 Claims, 9 Drawing Sheets

HUNTING ARROWHEAD ASSEMBLY

FIELD

The disclosure relates to a hunting arrowhead assembly, more particularly to a hunting arrowhead assembly with a pair of piercing members.

BACKGROUND

U.S. Pat. No. 4,742,637 discloses a fishing arrowhead for application to a bow and arrow, spear, gig or other fishing implement. The head has a U-shaped retaining barb which can be pivoted from a shooting position in which the barbs lie substantially in a plane passing through the longitudinal center line of the fishing implement and extending rearwardly from the tip of the implement to a fish holding position in which the barbs extend substantially at right angles to the longitudinal axis of the implement. The bight portion of the U-shaped retaining barb is rotatably secured in a bore which extends transversely through a cylindrical adapter which is secured to the fishing implement. The retaining barb is locked against pivotable motion beyond the desired holding position by the tip of the implement which is threaded onto the adapter. The retaining barb may be rotated from its fish holding position to a fish releasing position in which the barbs extend toward the tip of the implement and substantially along the longitudinal center line thereof by partially unthreading the tip from the implement. Complete disassembly is not required. A modification of the fishing head is also disclosed.

SUMMARY

An object of the disclosure is to provide a novel hunting arrowhead assembly.

According to the disclosure, a hunting arrowhead assembly for attachment to an arrow shank includes a shaft body, at least one guiding slot, a pair of access slots, a pin member, a pair of piercing members, a penetrating member, and a cam mechanism. The shaft body extends along a main axis in a longitudinal direction, and includes a forward segment, a rearward segment, and a middle segment. The forward segment has a front end surface, and defines therein a front axial hole which extends from the front end surface along the main axis, and which has an inner peripheral surface. The rearward segment is configured to be removably secured to the arrow shaft. The middle segment is disposed between the forward and rearward segments, and defines therein a middle axial hole extending along the main axis to communicate with the front axial hole. The guiding slot is formed in an outer peripheral surface of the middle segment proximate to the forward segment, and extends in a radial direction relative to the main axis to be spatial communication with the middle axial hole. The guiding slot extends in the longitudinal direction to terminate at a front limit and a rear limit. The access slots are formed in the outer peripheral surface of the middle segment, and extend in a diametrical direction transverse to the radial direction to be spatial communication with the middle axial hole. Each of the access slots extends in the longitudinal direction to terminate at a proximate end and a distal end relative to the forward segment. The pin member defines a pin axis and is disposed in the middle axis hole. The pin member has two pin end regions one of which extends outwardly of the guiding slot so as to permit the pin member to be shifted along the guiding slot. The pin member is movable between a front position, where the pin member is adjacent to the front limit, and a rear position, where the pin member is adjacent to the rear limit. Each of the piercing members has a pivot end, a piercing body, and a piercing free end. The pivot end is disposed in the middle axial hole and is pivotally mounted to the pin member about the pin axis. The piercing body extends radially from the pivot end along a lengthwise line which defines an included angle together with the main axis. The piercing free end is opposite to the pivot end along the lengthwise line. Each of the piercing members is angularly displaceable about the pin axis such that when the pin member is in the rear position, the piercing free end is disposed outwardly of a corresponding one of the access slots, and the included angle is changeable between a smaller angle, where the piercing free end is close to the middle segment, and a larger angle, where the piercing free end is remote from the middle segment, and such that when the pin member is in the front position, the piercing free end is retractable in the corresponding one of the access slots, and the included angle is a smallest angle. The penetrating member includes a head portion with a tip end, and a tail portion with an abutment end opposite to the tip end along the main axis. The tail portion is configured to be insertable through the front axial hole into the middle axial hole. The cam mechanism is disposed between the penetrating member and the forward segment to translate rotational movement of the head portion relative to the shaft body into translational movement of the tail portion relative to the shaft body to permit the abutment end to be moved from a stop position, where the abutment end is in the middle axial hole for abutting against the pivot ends of the piercing members to thereby retain the pin member in the rear position, to a release position, where the abutment end is moved away from the middle axial hole to permit the pin member to be displaced to the front position.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 1:
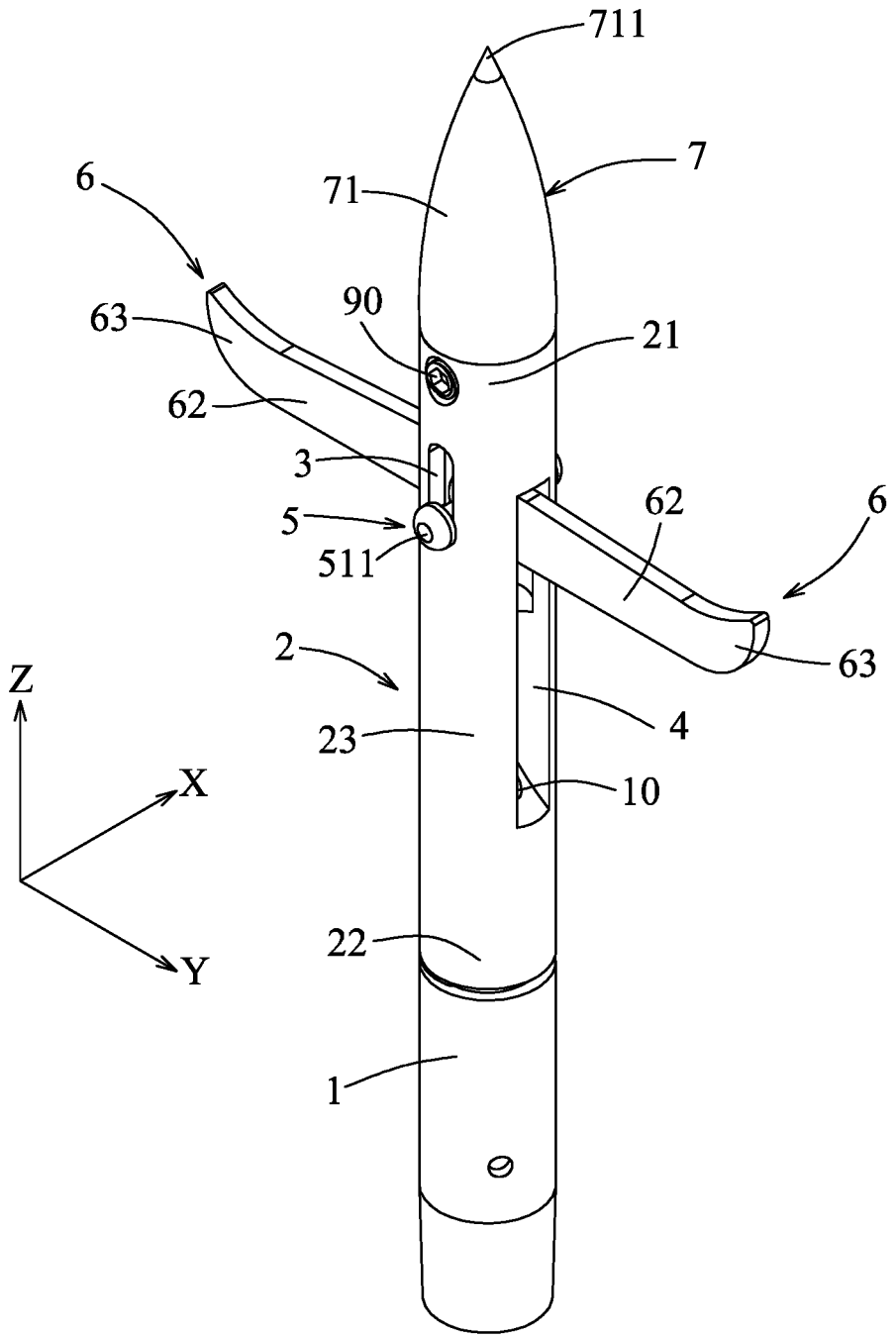
FIG. 1 is a perspective view of a hunting arrowhead assembly according to an embodiment of the disclosure.
Figure 2:
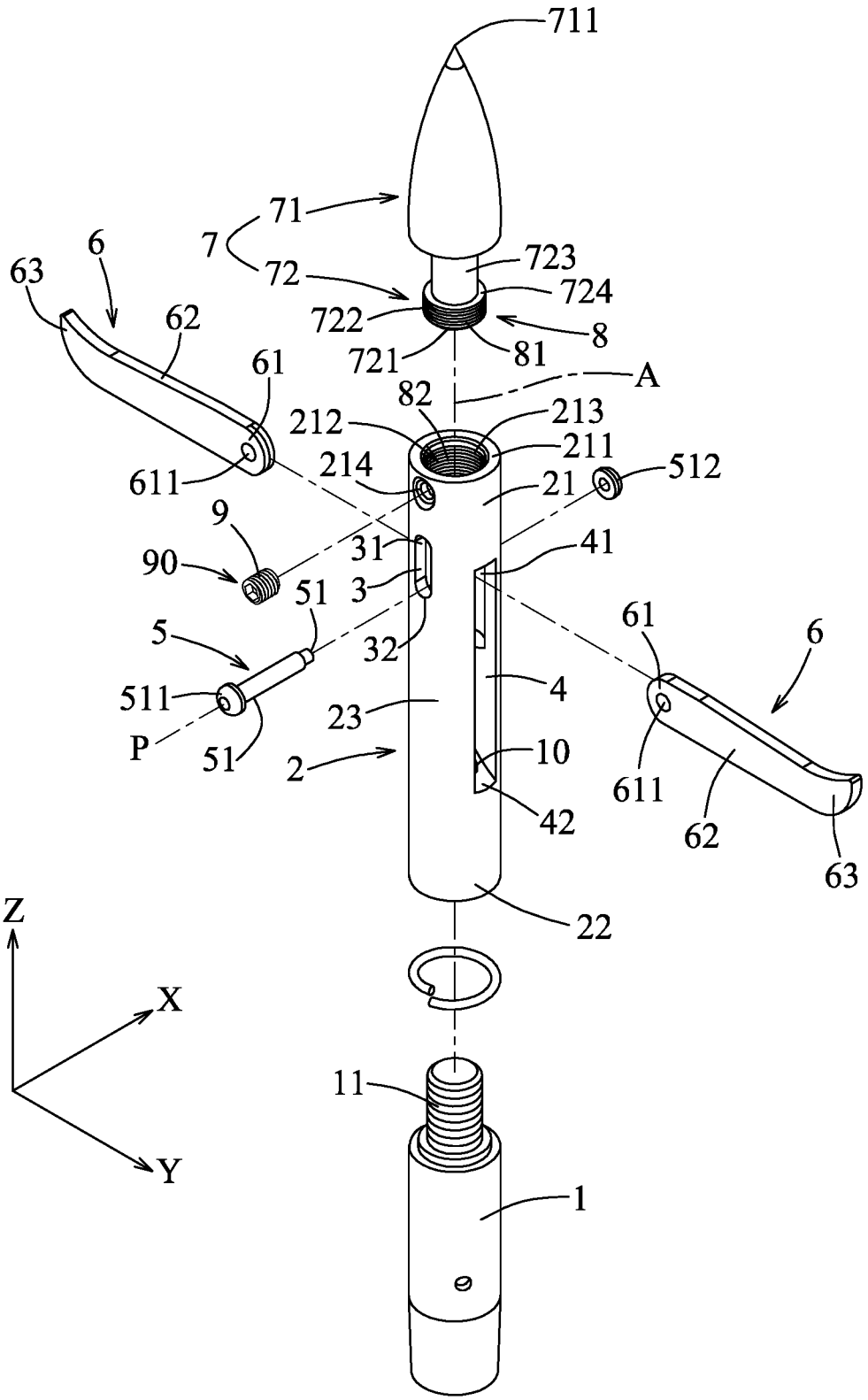
FIG. 2 is an exploded perspective view of the hunting arrowhead assembly.

Referring to FIGS. 1 and 2, a hunting arrowhead assembly for attachment to an arrow shank 1 according to an embodiment of this disclosure is shown to include a shaft body 2, at least one guiding slot 3, a pair of access slots 4, a pin member 5, a pair of piercing members 6, a penetrating member 7, and a cam mechanism 8.

Figure 3:
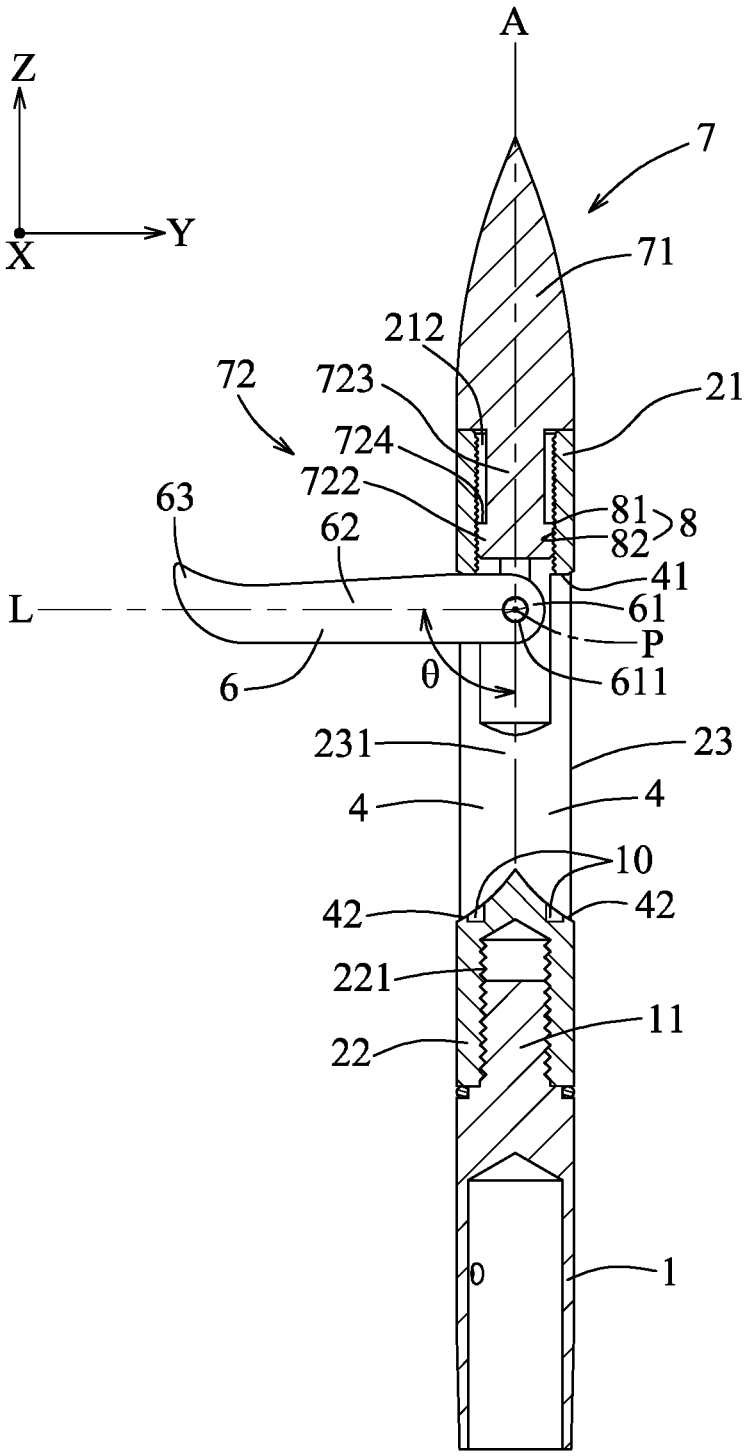
FIG. 3 is a cross-sectional view of FIG. 1 for illustrating a pair of access slots.
Figure 4:
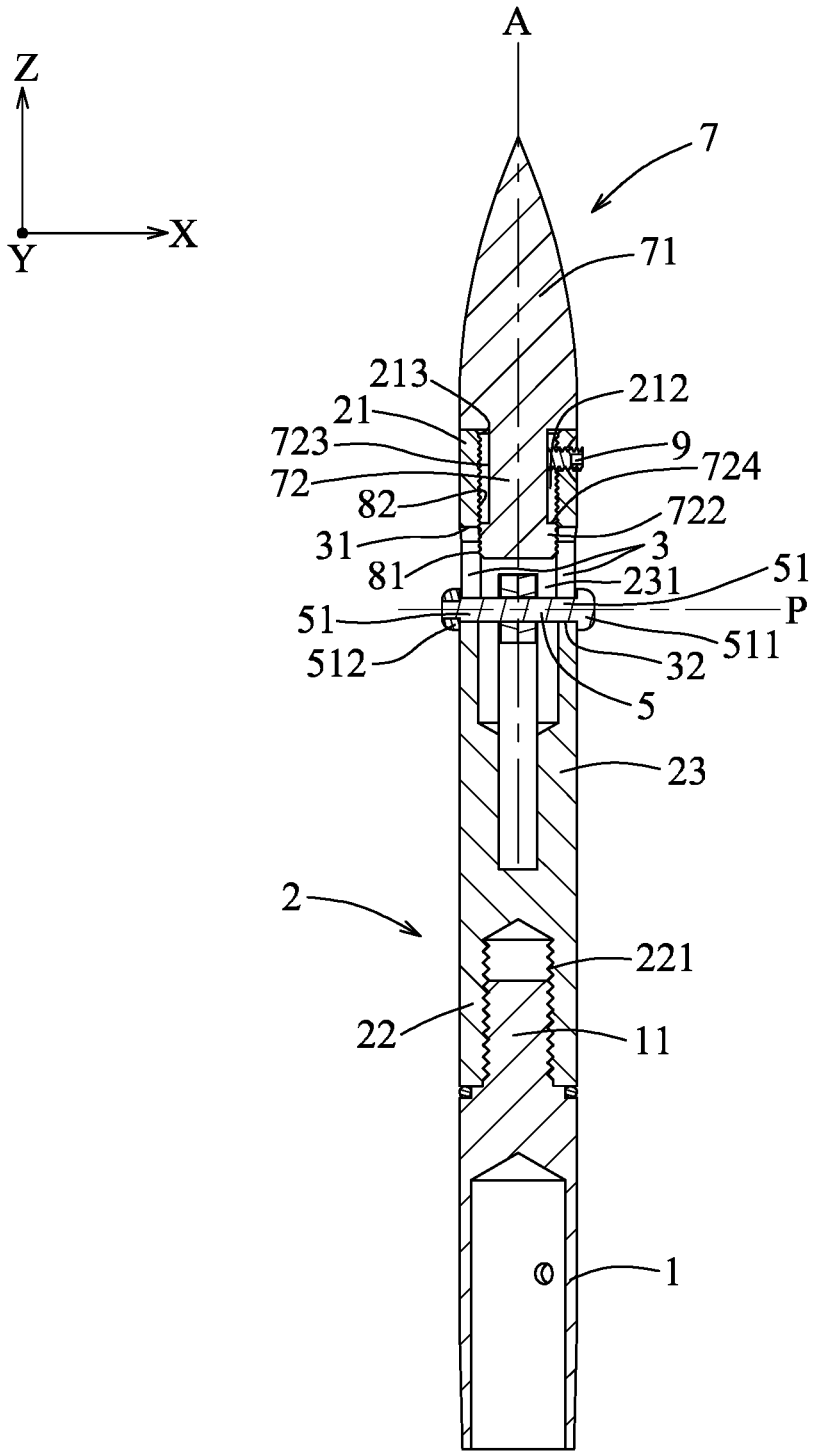
FIG. 4 is another cross-sectional view of FIG. 1 for illustrating a pair of guiding slots.

As shown in FIGS. 2 to 4, the shaft body 2 extends along a main axis (A) in a longitudinal direction (Z), and includes a forward segment 21, a rearward segment 22, and a middle segment 23 disposed between the forward and rearward segments 21, 22.

The forward segment 21 has a front end surface 211, and defines therein a front axial hole 212 which extends from the front end surface 211 along the main axis (A), and which has an inner peripheral surface 213.

The rearward segment 22 is configured to be removably secured to the arrow shaft 1. In an embodiment shown in FIGS. 2 to 4, the rearward segment 22 has a rear threaded hole 221 for threadingly receiving a male threaded end segment 11 of the arrow shaft 1.

The middle segment 23 defines therein a middle axial hole 231 extending along the main axis (A) to communicate with the front axial hole 212.

The guiding slot 3 is formed in an outer peripheral surface of the middle segment 23 proximate to the forward segment 21. The guiding slot 3 extends in a radial direction (X) relative to the main axis (A) to be spatial communication with the middle axial hole 231. The guiding slot 3 extends in the longitudinal direction (Z) to terminate at a front limit 31 and a rear limit 32.

In an embodiment shown in FIG. 4, the hunting arrowhead assembly includes two of the guiding slots 3 which are in register with each other in the radial direction (X).

The access slots 4 are formed in the outer peripheral surface of the middle segment 23, and extend in a diametrical direction (Y) transverse to the radial direction (X) to be spatial communication with the middle axial hole 231. Each of the access slots 4 extends in the longitudinal direction (Z) to terminate at a proximate end 41 and a distal end 42 relative to the forward segment 21.

Figure 9:
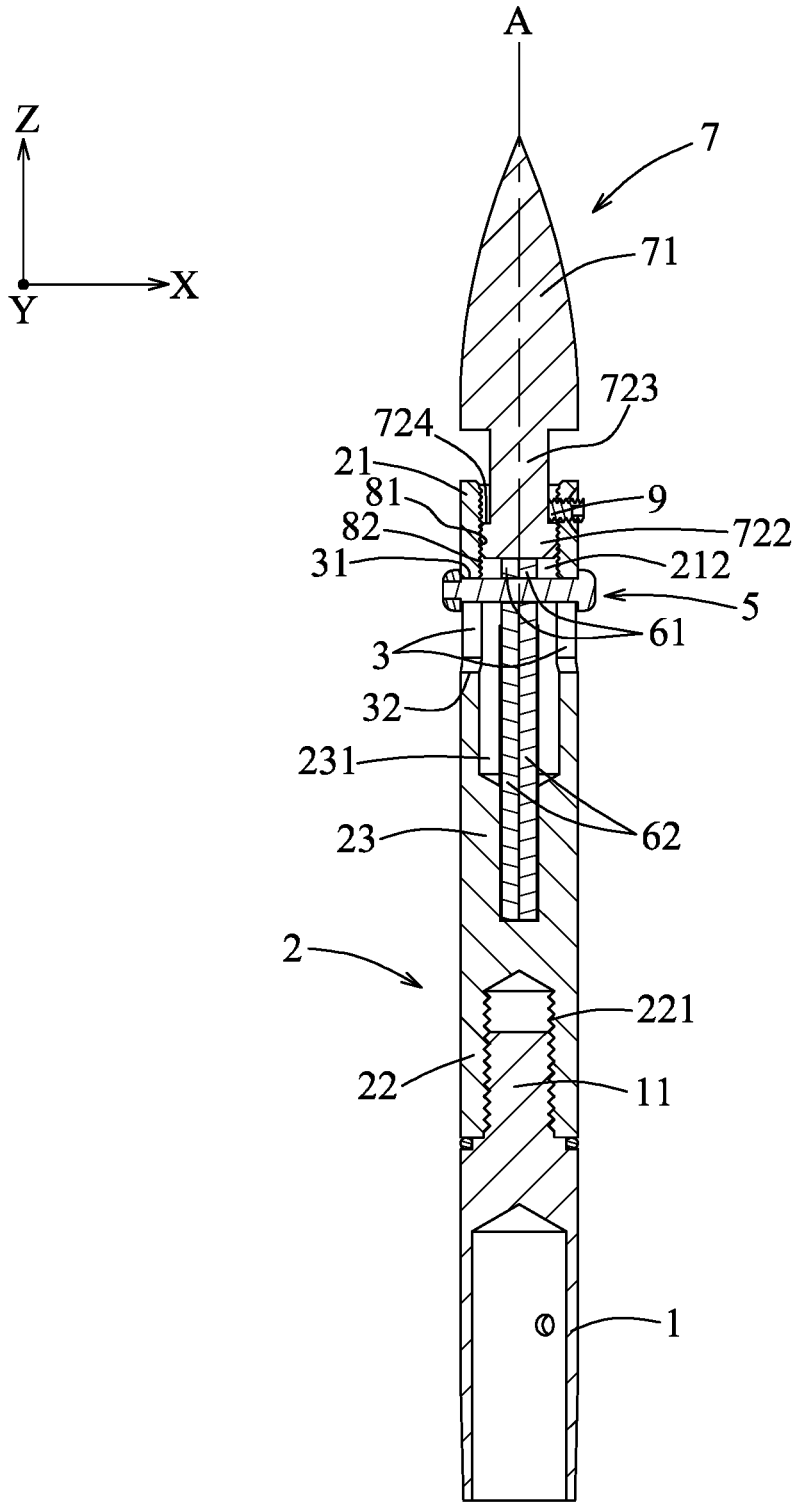
FIG. 9 is another cross-sectional view of FIG. 7 for illustrating the guiding slots.

The pin member 5 defines a pin axis (P) and is disposed in the middle axis hole 231. The pin member 5 has two pin end regions 51 one of which extends outwardly of the guiding slot 3 so as to permit the pin member 5 to be guided by and shifted along the guiding slot 3. The pin member 5 is movable between a front position and a rear position. In the front position, as shown in FIG. 9, the pin member 5 is adjacent to the front limit 31. In the rear position, as shown in FIG. 4, the pin member 5 is adjacent to the rear limit 32.

In an embodiment shown in FIGS. 2 and 4, the pin end regions 51 of the pin member 5 extend outwardly of the guiding slots 3, respectively. The pin member 5 has a first enlarged end 511 and a second enlarged end 512 which are respectively connected to the pin end regions 51 to be disposed outside of the middle segment 23. The second enlarged end 512 is removably secured to a corresponding one of the pin end regions 51.

In one embodiment, the pin member 5 may be manually moved between the front and rear positions. In another embodiment, the pin member 5 may be biased to the front position using a biasing member (not shown).

Each of the piercing members 6 has a pivot end 61, a piercing body 62, and a piercing free end 63.

The pivot end 61 is disposed in the middle axial hole 231 and is pivotally mounted to the pin member 5 about the pin axis (P).

The piercing body 62 extends radially from the pivot end 61 along a lengthwise line (L) which defines an included angle (θ) together with the main axis (A).

The piercing free end 63 is opposite to the pivot end 61 along the lengthwise line (L). In an embodiment shown in FIGS. 1 and 3, the piercing free end 63 in the form of a barb tip.

Each of the piercing members 6 is angularly displaceable about the pin axis (P).

As shown in FIGS. 1 and 3 to 6, when the pin member 5 is in the rear position, the piercing free end 63 is disposed outwardly of a corresponding one of the access slots 4, and the included angle (θ) is changeable between a smaller angle and a larger angle.

Figure 5:
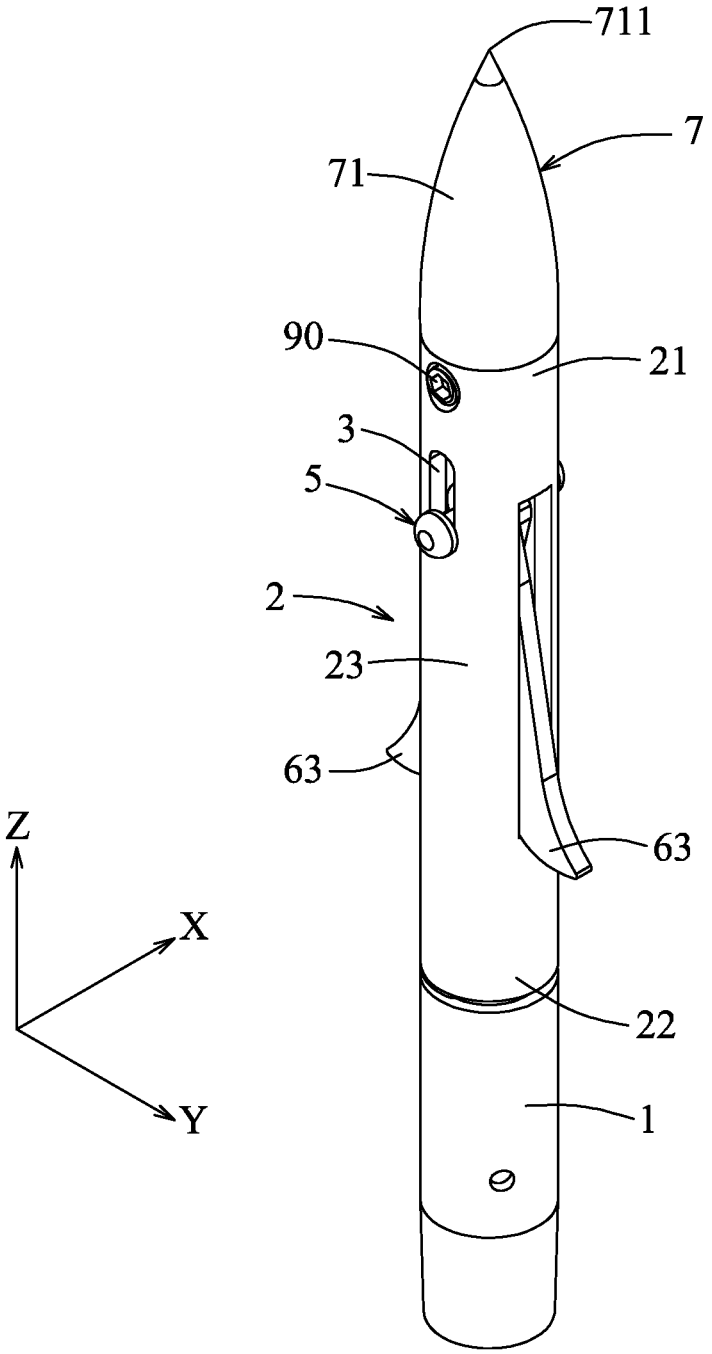
FIG. 5 is similar to FIG. 1 but illustrating a pair of piercing members in a collapsed position.
Figure 6:
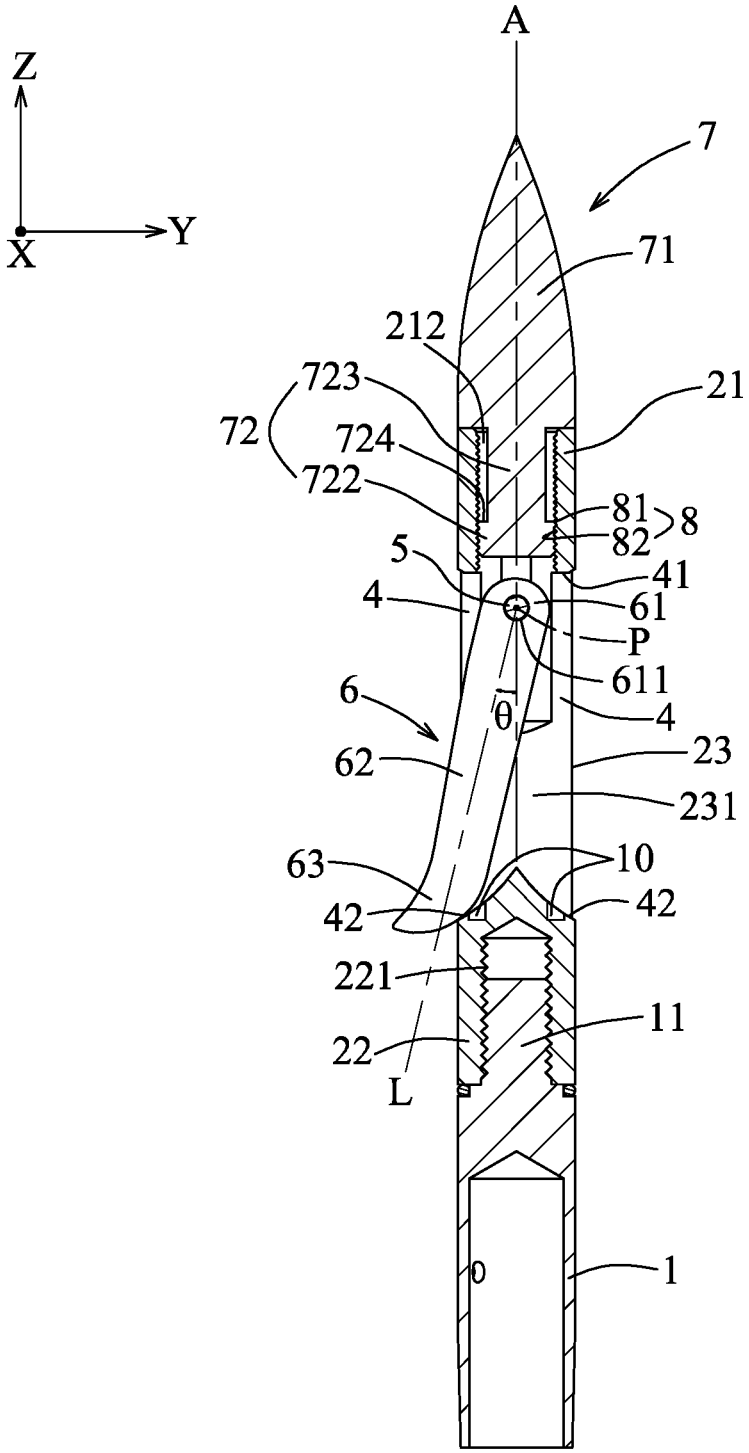
FIG. 6 is a cross-sectional view of FIG. 5 for illustrating the access slots.

When the included angle (θ) is the smaller angle, as shown in FIGS. 5 and 6, the piercing free end 63 is close to the middle segment 23. In this case, the piercing members 6 are in a collapsed position.

When the included angle (θ) is the larger angle, as shown in FIGS. 1 and 3, the piercing free end 63 is remote from the middle segment 23. In this case, the piercing members 6 are in a deployed position.

Figure 7:
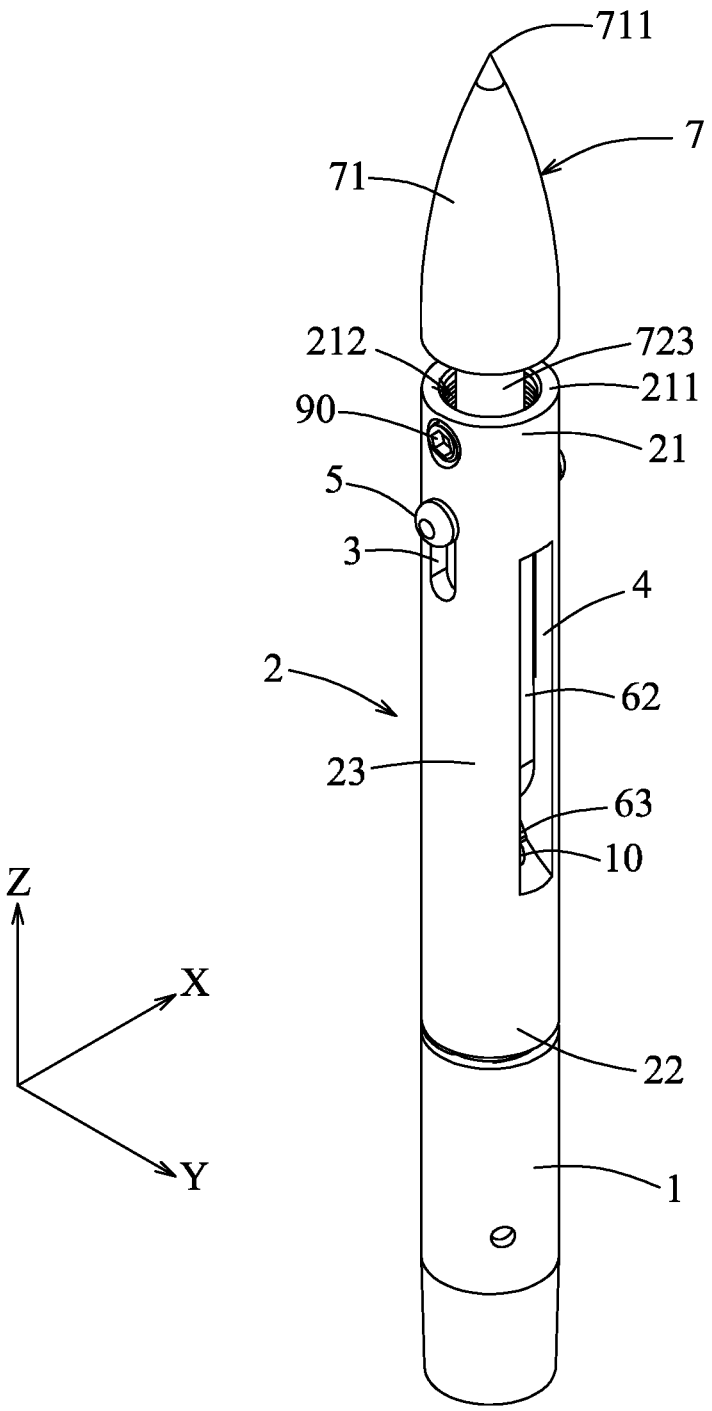
FIG. 7 is similar to FIG. 1 but illustrating the piercing members in a retracted position.
Figure 8:
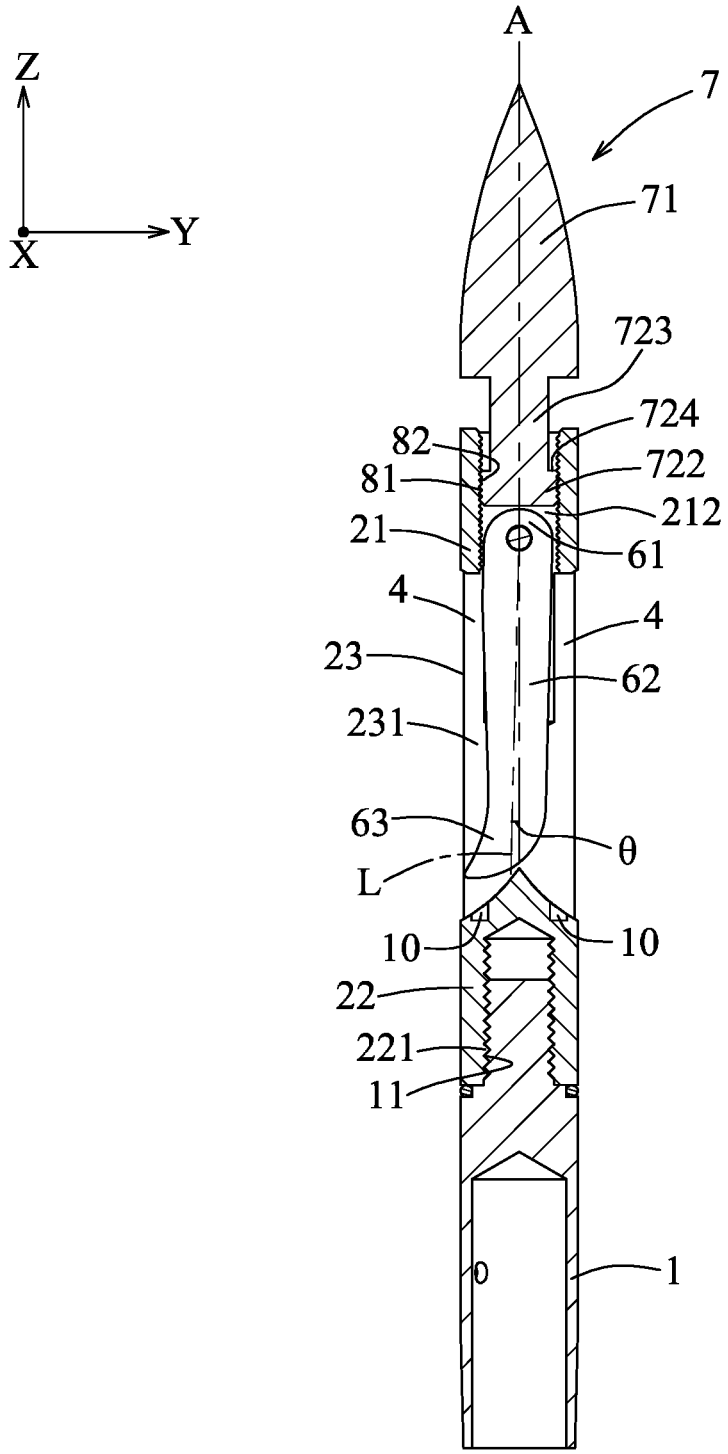
FIG. 8 is a cross-sectional view of FIG. 7 for illustrating the access slots.

As shown in FIGS. 7 to 9, when the pin member 5 is in the front position, the piercing free end 63 is retractable in the corresponding one of the access slots 63, and the included angle (θ) is a smallest angle. In this case, the piercing members 6 are in a retracted position.

In an embodiment shown in FIGS. 2 and 3, the pivot end 61 has a pivot hole 611 configured to permit the piercing members 6 to be sequentially sleeved on the pin member 5. In a process of assembling, the second enlarged end 512 is removed from the corresponding one of the pin end regions 51, the piercing members 6 are sequentially sleeved on the pin member 5 when the pin member 5 passes through the two guiding slots 3, and then the second enlarged end 512 is secured to the corresponding one of the pin end regions 51 again.

The penetrating member 7 includes a head portion 71 with a tip end 711, and a tail portion 72 with an abutment end 721 opposite to the tip end 711 along the main axis (A). The tail portion 72 is configured to be insertable through the front axial hole 212 into the middle axial hole 231.

In an embodiment shown in FIGS. 2 to 4, the tail portion 72 has an end region 722, and a neck region 723 which is disposed between the end region 722 and the head portion 71, and which defines a shoulder 724 together with the end region 722.

The cam mechanism 8 is disposed between the penetrating member 7 and the forward segment 21 to translate rotational movement of the head portion 71 relative to the shaft body 2 into translational movement of the tail portion 72 relative to the shaft body 2 to permit the abutment end 721 to be moved from a stop position and a release position. When the abutment end 721 is in the stop position, as shown in FIG. 4, the abutment end 721 is in the middle axial hole 231 for abutting against the pivot ends 61 of the piercing members 6 to thereby retain the pin member 5 in the rear position. When the abutment end 721 is in the release position, as shown in FIG. 9, the abutment end 721 is moved away from the middle axial hole 231 to permit the pin member 5 to be displaced to the front position.

Normally, the pin member 5 is in the rear position and the included angle (θ) is the smaller angle (FIGS. 5 and 6). When a prey (not shown) is shot and struggles to break free from the hunting arrowhead assembly, the barb tip 63 is forced outwardly by the escaping prey such that the included angle (θ) is changed to the larger angle (FIGS. 1 and 3) to thereby prevent the prey from breaking free. For removal of the prey from the hunting arrowhead assembly, it is only necessary to rotate the head portion 21 relative to the shaft body 2 to permit the pin member 5 to be displaced to the front position (FIGS. 7 to 9). In this case, the piercing free end 63 can be fully retracted in the corresponding one of the access slots 63 to facilitate removal of the prey.

In an embodiment shown in FIGS. 2 to 4, the cam mechanism 8 includes male threads 81 and female threads 82. The male threads 81 are formed on the tail portion 72. The female threads 82 are formed on the inner peripheral surface of the forward segment 21, and are configured to mate with the male threads 81 so as to translate the rotational movement of the head portion 71 into the translational movement of the tail portion 72.

In an embodiment shown in FIGS. 2 to 4, the male threads 81 are formed on the end region 722.

In an embodiment shown in FIG. 4, the hunting arrowhead assembly further includes a peg 9 which is disposed on the inner peripheral surface 213 of the forward segment 21, and which extends toward the neck portion 723 to limit movement of the shoulder 724 so as to prevent removal of the tail portion 72 from the front axial hole 212.

In an embodiment shown in FIG. 2, the hunting arrowhead assembly further includes a female threaded hole 214 and a male threaded member 90.

The female threaded hole 214 extends inwardly from an outer peripheral surface of the forward segment 21 to communicate with the front axial hole 212.

The male threaded member 90 is configured to mate with the female threaded hole 214 so as to be threaded into the front axial hole 212 to serve as the peg 9.

In an embodiment, each of the piercing members 6 is made from a magnetically attractive material, and the hunting arrowhead assembly further includes two magnets 10 each of which is disposed in a corresponding one of the access slots 4 near the distal end 42 so as to ensure the included angle (θ) to be at the smaller angle.

The hunting arrowhead assembly may be applied to an archery device with a bow and an arrow, a crossbow device, and so on.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A hunting arrowhead assembly for attachment to an arrow shank, comprising:

a shaft body extending along a main axis in a longitudinal direction, and including a forward segment having a front end surface, and defining therein a front axial hole which extends from said front end surface along the main axis, and which has an inner peripheral surface, a rearward segment configured to be removably secured to the arrow shaft, and a middle segment which is disposed between said forward and rearward segments, and which defines therein a middle axial hole extending along the main axis to communicate with said front axial hole;

at least one guiding slot which is formed in an outer peripheral surface of said middle segment proximate to said forward segment, and which extends in a radial direction relative to the main axis to be spatial communication with said middle axial hole, said guiding slot extending in the longitudinal direction to terminate at a front limit and a rear limit;

a pair of access slots which are formed in said outer peripheral surface of said middle segment, and which extend in a diametrical direction transverse to the radial direction to be spatial communication with said middle axial hole, each of said access slots extending in the longitudinal direction to terminate at a proximate end and a distal end relative to said forward segment;

a pin member which defines a pin axis and which is disposed in said middle axis hole, said pin member having two pin end regions one of which extends outwardly of said guiding slot so as to permit said pin member to be shifted along said guiding slot, said pin member being movable between a front position, where said pin member is adjacent to said front limit, and a rear position, where said pin member is adjacent to said rear limit;

a pair of piercing members each having a pivot end which is disposed in said middle axial hole and which is pivotally mounted to said pin member about the pin axis, a piercing body extending radially from said pivot end along a lengthwise line which defines an included angle together with the main axis, and a piercing free end opposite to said pivot end along the lengthwise line, each of said piercing members being angularly displaceable about the pin axis such that when said pin member is in the rear position, said piercing free end is disposed outwardly of a corresponding one of said access slots, and said included angle is changeable between a smaller angle, where said piercing free end is close to said middle segment, and a larger angle, where said piercing free end is remote from said middle segment, and such that when said pin member is in the front position, said piercing free end is retractable in the corresponding one of said access slots, and the included angle is a smallest angle;

a penetrating member including a head portion with a tip end, and a tail portion with an abutment end opposite to said tip end along the main axis, said tail portion being configured to be insertable through said front axial hole into said middle axial hole; and a cam mechanism disposed between said penetrating member and said forward segment to translate rotational movement of said head portion relative to said shaft body into translational movement of said tail portion relative to said shaft body to permit said abutment end to be moved from a stop position, where said abutment end is in said middle axial hole for abutting against said pivot ends of said piercing members to thereby retain said pin member in the rear position, to a release position, where said abutment end is moved away from said middle axial hole to permit said pin member to be displaced to the front position.

2. The hunting arrowhead assembly as claimed in claim 1, which comprises two of said guiding slots configured to permit both said pin end regions of said pin member to extend outwardly of said guiding slots, respectively.

3. The hunting arrowhead assembly as claimed in claim 1, wherein said cam mechanism includes male threads formed on said tail portion, and female threads which are formed on said inner peripheral surface of said forward segment, and which are configured to mate with said male threads so as to translate the rotational movement of said head portion into the translational movement of said tail portion.

4. The hunting arrowhead assembly as claimed in claim 3, wherein said tail portion has an end region on which said male threads are formed, and a neck region which is disposed between said end region and said head portion, and which defines a shoulder together with said end region, said hunting arrowhead assembly further comprising a peg which is disposed on said inner peripheral surface of said forward segment, and which extends toward said neck portion to limit movement of said shoulder so as to prevent removal of said tail portion from said front axial hole.

5. The hunting arrowhead assembly as claimed in claim 4, further comprising:

a female threaded hole extending inwardly from an outer peripheral surface of said forward segment to communicate with said front axial hole; and a male threaded member configured to mate with said female threaded hole so as to be threaded into said front axial hole to serve as said peg.

6. The hunting arrowhead assembly as claimed in claim 1, wherein each of said piercing members is made from a magnetically attractive material, said hunting arrowhead assembly further comprising two magnets each of which is disposed in a corresponding one of said access slots near said distal end so as to ensure said included angle to be at the smaller angle.

7. The hunting arrowhead assembly as claimed in claim 1, wherein said pivot end has a pivot hole configured to permit said piercing members to be sequentially sleeved on said pin member.

8. The hunting arrowhead assembly as claimed in claim 1, wherein said piercing free end is in the form of a barb tip.

* * * * *